United States Patent [19]

Berti et al.

[11] Patent Number: 4,479,741

[45] Date of Patent: Oct. 30, 1984

[54] DEVICE FOR LAYING UNDERGROUND OR DIGGING UP SUBSEA CONDUITS

[75] Inventors: Alfredo Berti, Fano; Attilio Ilari, Bologna, both of Italy

[73] Assignee: Snamprogetti S.p.A., Milan, Italy

[21] Appl. No.: 371,730

[22] Filed: Apr. 26, 1982

[30] Foreign Application Priority Data

May 4, 1981 [IT] Italy ..... 21494 A/81

[51] Int. Cl.[3] ..... F16L 1/04; E02F 3/88

[52] U.S. Cl. ..... 405/163; 405/162; 37/63

[58] Field of Search ..... 405/158–164, 405/173; 37/61–63

[56] References Cited

U.S. PATENT DOCUMENTS

| | | | |
|---|---|---|---|
| 2,774,569 | 12/1956 | Jacobsen | 37/63 |
| 3,585,740 | 6/1971 | De Koning | 37/63 |
| 3,673,808 | 7/1972 | Volbeda | 405/161 |
| 3,717,003 | 2/1973 | Bates | 37/63 X |
| 3,851,492 | 12/1974 | Cannon | 405/158 X |
| 3,877,237 | 4/1975 | Norman | 405/163 X |
| 3,978,679 | 9/1976 | Lecomte | 37/63 X |
| 4,112,695 | 9/1978 | Chang | 405/163 |
| 4,117,689 | 10/1978 | Martin | 405/163 |
| 4,165,571 | 8/1979 | Chang | 37/62 |
| 4,342,526 | 8/1982 | Mousselli | 405/163 X |

*Primary Examiner*—Cornelius J. Husar
*Assistant Examiner*—Nancy J. Stodola
*Attorney, Agent, or Firm*—Hedman, Gibson, Costigan & Hoare

[57] ABSTRACT

A self-propelling device for burying and digging up subsea conduits laid on beds of an incoherent material. The device has:

disintegrating members using high pressure water jets to create a slurry of material, digging members having suction members which draw the suspension prepared by the disintegrating members, thus leaving a trench behind, and displacement members for moving the device on the seabed astride the conduit.

9 Claims, 4 Drawing Figures

DEVICE FOR LAYING UNDERGROUND OR DIGGING UP SUBSEA CONDUITS

Figure 1:
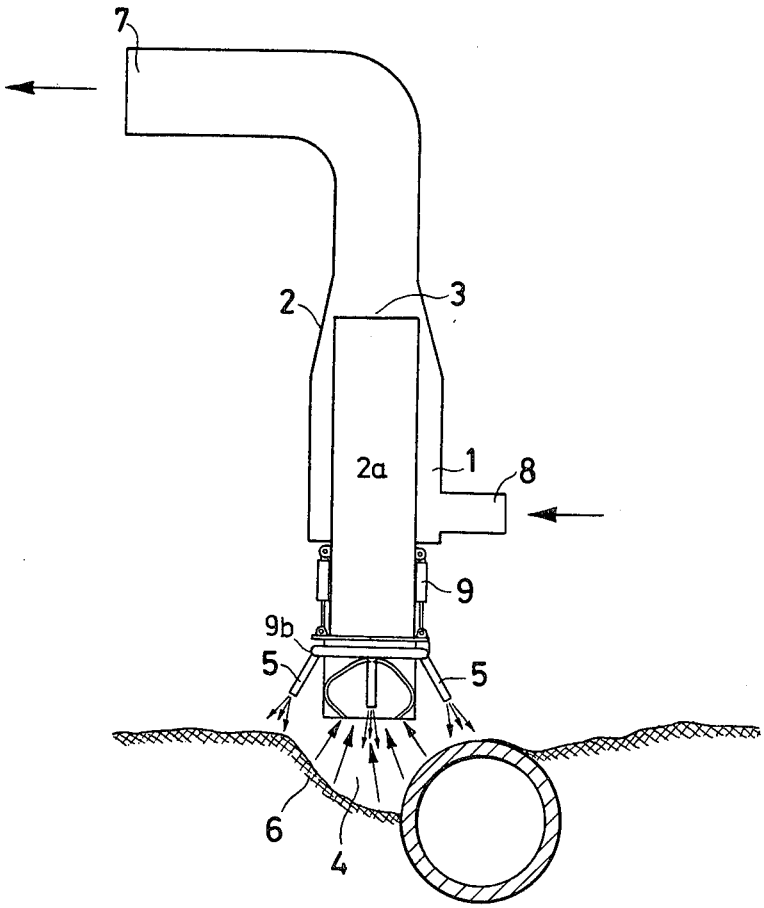

Subsea conduits laid at great depths on incoherent sea beds may be subject to interment which are more or less pronounced and often as a function of the muddy nature of the soil sediment which build up with the lapse of time due to the variable conditions of the sea.

During the normal service life of a conduit the degree of interment is an obvious safety measure, both in connection with the stability of the conduit and the protection against accidental damage by anchors, fishing nets and the like and by natural events, such as the action of underwater currents.

For these reasons, resort is often had, in a few instances, to artificial burying of the conduits, with the formation of embankments.

The material of the embankment is one having a rather coarse grit size, such as the mixed type occurring in quarries.

From the standpoint of possible repair the degree of interment, conversely, is a serious difficulty.

The difficulty lies both in localizing the position of the conduit and in digging it out of the ground to carry out the repair.

At depths which are not exceptional, the search and operations can be carried out by frogmen, but, as the depth is increased, only subsea apparatus can be used, which are manned internally and are equipped with external tools. Such means have the disadvantages that their operation is very expensive and their field of action is restricted.

There are instances in which it is even more advisable to abandon the damaged conduit and to lay a new one.

The use of subsea conduits at great depths, especially on deep seabeds is more and more widespread and the problem of repairing such conduits is becoming more and more significant.

The device according to the present invention makes it possible both to bury a conduit and to dig it up in such a way as to present the conduit under the best possible condition for any repair thereon.

The device is characterized by a high operative capacity, is not manned and does not encounter, in practice, any limits as to the depth at which it can be actuated.

The device according to the invention includes a supporting structure on which housed and are secured component parts necessary for the various operations, and which comprise:

operative members,
displacement members,
a assembly,
actuation members.

The supporting structure has a frame composed of rolled sections, a baseplate and metallic chambers, preferably of a cylindrical shape, forming a buoyancy system.

The chambers can be filled or emptied of water with the aid of compressed air, thus giving the device as a whole the necessary positive or negative buoyancy, as the case may be.

The compressed air is fed to the chambers either directly from a surface vessel or by bottles charged with air under high pressure and carried by the device itself.

As an alternative, the emptying and filling of the chambers can be carried out by pumps.

The buoyancy chambers on cylinders are connected to the structure of the device by lifting lugs or equivalent means for rapid connection, so that they can be mounted and dismantled rapidly. As a matter of fact, the device can be sunk either with the help of the chambers or without the use of chambers by exploiting the weight acting through a pull cable connected to the device and paid out from the surface vessel.

In the front portion, of the device jutting out of a central portion thereof, there can be an assembly of the operative members including a scooping system and disaggregating nozzles, fed by water under high pressure.

The scooping system is composed of one or more large pipes, preferably paired, arranged vertically and having a telescopable end portion.

In the lower portion of the scooping pipes, there are placed the water-jet disaggregating nozzles which form the water-sediment suspensions removed by the scooping system.

Figure 2:
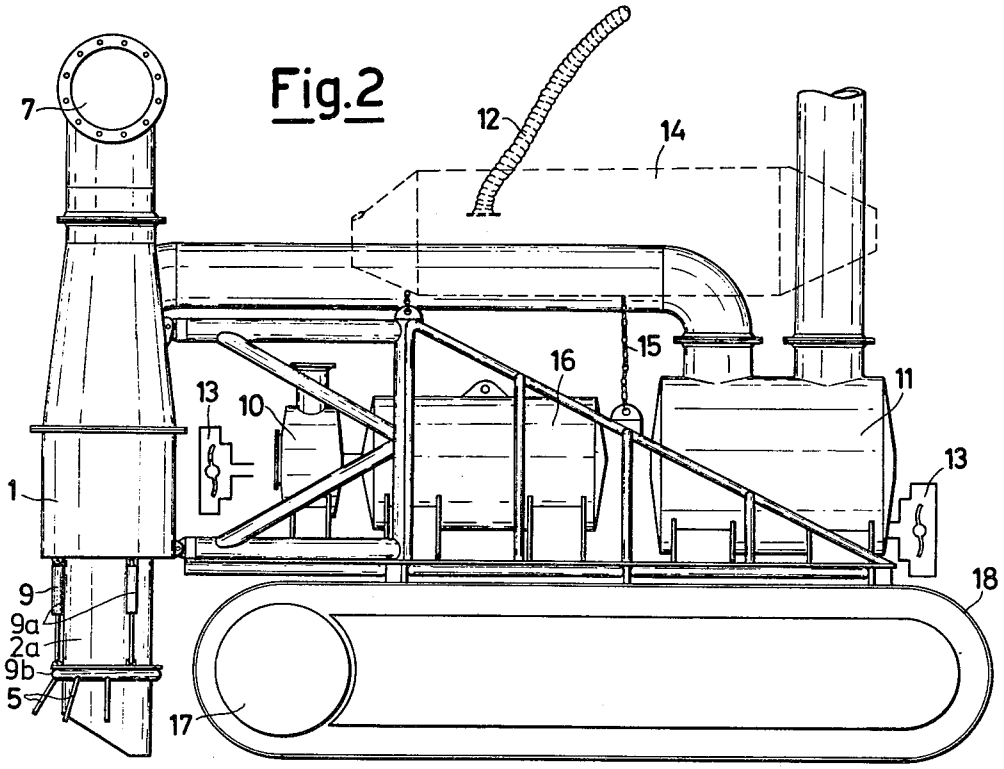
Figure 3:
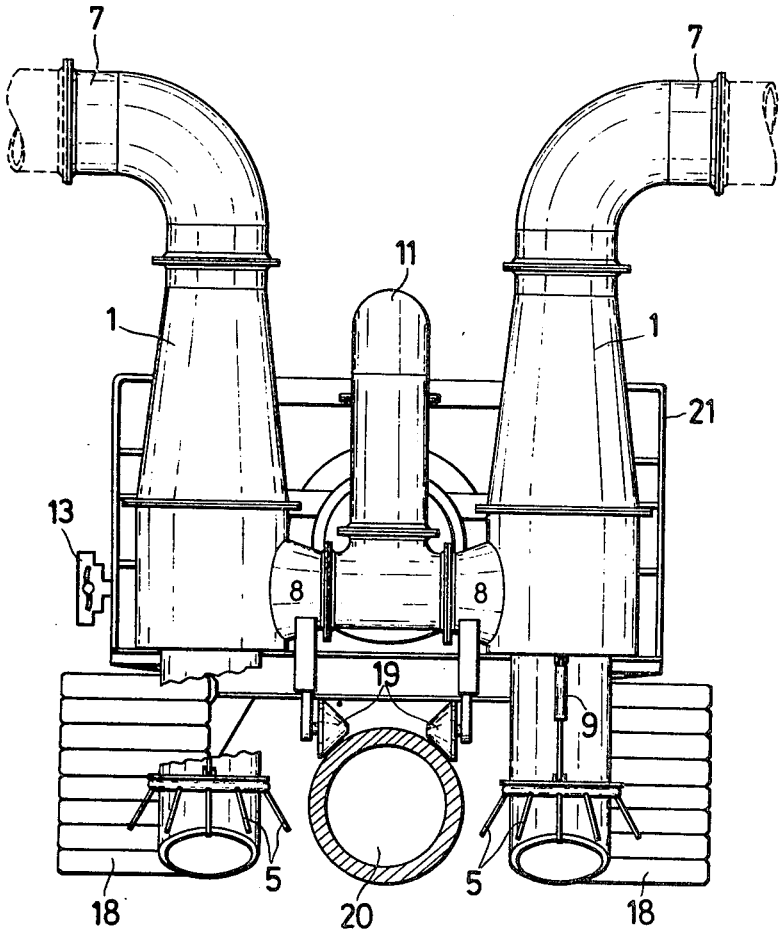
Figure 4:
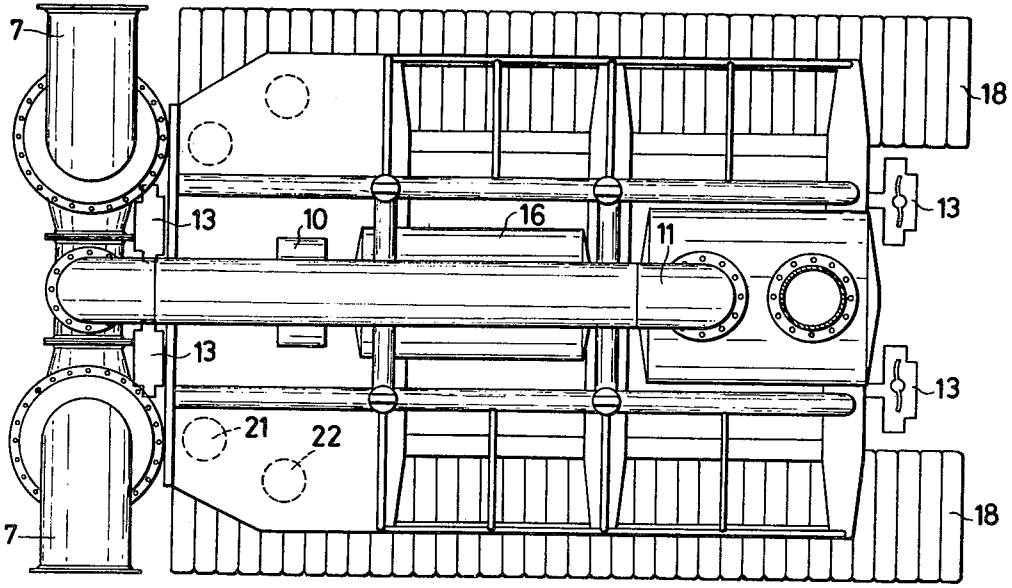

The telescopable end portion enables the scooping units to be positioned individually at the desired level above the sea bed thus permitting that the rate of flow of the suspension or to be adjusted to any desired value. As described more fully hereinafter and illustrated in the drawings, the scooping units can be constructed on the suction principle and with the aid of the disaggregating jets. With respect to the drawings: FIG. 1 is a front elevation diagrammatically illustrating the operation of a scooping unit of the invention; FIG. 2 is a side elevation of a preferred embodiment of the invention; FIG. 3 is a front elevation of the preferred embodiment of the invention shown in FIG. 2; and FIG. 4 is a plan view of the preferred embodiment of the invention shown in FIG. 3.

Referring to FIG. 1, the operation of the scooping units 1 is based on the venturi effect caused by the flow of a water stream through a venturi cone 2 of each unit 1. As shown, the unit 1 has a tube 2*a* which extends from the cone 2 toward the sea bed and into the cone 2 to the restricted area 3. Due to the Venturi effect, a negative pressure in the area 3 to draw from the sea bed 2 slurry 4 produced by the action of the disaggregating nozzles 5 upon the seabed and 6. The scooping assembly is fed by a low-pressure centrifugal pump 11, (See FIGS. 2 to 4) having a high rate of delivery. The disaggregating jets 5 are fed through a high pressure pump 10. The slurry thus obtained is discharged through 7. The scooping assembly is fed with water via conduit 8. The distance from the sea bed of the end of the scooping assembly 1 and of the disaggregating nozzles 5 secured thereto can be adjusted by the telescopable devices 9. As illustrated the telescopable device 9 includes jacks 9*a* about the tube 2*a* which are connected to an annular manifold 9*b* from which the nozzles extend.

As an alternative to the described operation the device can have suction units directly connected to the suction side of a centrifugal pump having the rotors in an arreared position. This kind of pump prevents the detrimental effect due to the material flowing between the rotor blades. The displacement members for the device permit the motion on the sea bottom bed and the immersion navigation.

In general, the movement of the device on the seabed is ensured by a crawler track system driven by hydraulic motors directly secured thereto. The device also is equipped with a propulsion system comprising a plurality of propelling screws which allows the device to be displaced in any direction when the device is not on the seabed. The propulsion system is very useful for navigation and for searching for buried conduits. All the motors and the instruments and the means of the machine are electrically controlled. The transfer of the necessary power takes place from the surface of the sea and by means of an electric feeding cable housed within a flexible tubing of the Coflexip type or by directly floating in the sea.

The device in addition is connected to the surface or depot vessel by a pull cable used for launching the conduits and for hauling them aboard.

The steering of the device and the control of its operations takes place by means of instruments at the surface which are connected to the device through electric cables.

The signals delivered by the control devices as well as the images sent by TV-cameras can be displayed on a control panel at the surface.

The steering of the device can be manual or mechanical or both.

The vehicle is guided by instruments such as a pipe track, a magneto-meter, a beacon, a depth-meter, a echo-sounding device, a sonar device, a acoustical positioning device with transponders and TV-cameras.

The depot vessel or ship preferably should be equipped for dynamic positioning.

The actuating members of the device preferably are electric motors in an oil bath so as to be unaffected by the sea at great depths.

By way of illustration and without limitation of the device of the invention, an exemplary embodiment will now be described with reference to FIGS. 2, 3, 4.

In the side elevational view of FIG. 2 there is shown a high pressure pump 10 which feeds water to the disaggregating nozzles 5, a low pressure pump 11 which feeds water to the scooping units 1, *a* floating flexible conduit 12 for connecting the depot ship with the device, propelling screws 13 for navigation, air tanks 14 connecting chains 15, electric motors 16 for actuating the pumps 10 and 11 hydraulic movers 17 which actuate the crawler tracks 18.

As shown in FIG. 2, the lower end of the tube 2*a* is truncated or beveled in the direction of forward movement of the device and the nozzles 5 are placed above the front of the tube 2*a* coaxially therewith to facilitate suction and removal of material from the seabed. To further facilitate the operation of the device, and as shown in FIG. 2, the telescopic device 9 can vertically move the nozzles 5 relative to the seabed, and the nozzles 5 are positioned at an acute angle relative to the tube 2*a*.

In the front elevational view of FIG. 3 there is shown the guiding rollers 19 for the digging operations, conduit 20 and the frame 21 which supports the pumps, the motors and the other component parts of the device.

In the top plan view of FIG. 4 there are indicated at 21 and 22 the positions at which the search and positioning systems are located.

The device can be used for digging up the conduit 20 buried in a blanket of sandy sediment or other incoherent material, and for digging of a trench astride the conduit 20 placed on a seabed normally consisting of sand or other incoherent material.

For the digging operation, the device, once it has found the conduit 20, is positioned astride the conduit 20 and begins to dig the seabed by being slowly advanced at a speed enabling it to sink and find the conduit 20. On completion of this initial stage, the speed of advance is increased to the value which, on the basis of the rate of flow of suction permits that the device to leave behind the conduit 20 exposed and normally laying on the seabed ready for inspection and possible repair.

The adjustment of the height from the bottom of the two scooping units 1 to the seabed permits an individual adjustment of the rate of flow of suction. This enables the device to adjust the rate of flow to the different morphological conditions of the seabed and/or the different kind of material which is upstream and downstream of the conduit 20.

The device can dig a trench under a conduit 20 laid on the bottom and on a bed consisting of sand or any other loose material.

The device is positioned above the conduit 20 and draws a quantity of material from each side to form a hollow space therebelow and into which the conduit 20 descents under its own weight.

The speed and the distance of the scooping units 1 relative to and from the seabed adjust the rate of flow of the drawn suspension and thus the depth of the trench. By making a plurality of passes the depth of the trench is increased at will.

Obviously the device also can be employed for filling the trench by introducing thereinto the material in suspension as drawn from different points of the seabed.

By way of example, a device made according to the description of FIGS. 2, 3, 4 when employed for reburying a 20-inch jointed conduit, can draw a fluid mass having suspended therein loose material with a size of 10 to 12 cm, with scooping units placed, for example at, a distance of 150 mm from the seabed. The device can move at a speed of about 60 meters an hour when a digging a trench of about 30 cm in depth.

The dimensions of the device are about 4.40 meters in length, 2.60 meters in width and 3.30 meters in height.

The device has two scooping units having a rate of flow of about 6 cubic meters per minute, and the power is 45 HP for each unit. The inside diameter of the scooping units is 400 mm.

The power indicated above is supplied by electric motors (in oil bath) for both the high pressure pump and the low pressure pump.

The width of the trench is about 60 cm on each side. As regards the disintegrating nozzles, the rates of flow are moderate and the feeding pressures are high. The installed power is sufficient disaggregate seabeds which are consolidated to a medium degree. As a total, the installed power for the device is about 200 HP.

We claim:

1. A device for burying a conduit on a seabed of incoherent material and for digging up a conduit buried in a seabed of incoherent material, the device comprising:

a pair of scooping units adapted for positioning on opposite sides of the conduit, wherein each unit includes a venturi tube having an intermediate portion of restricted cross section, a slurry tube within said venturi tube having an upper end at said restricted cross section of said venturi tube adapted to be positioned on one side of the conduit and adjacent the seabed, wherein said lower end is beveled in the direction of advancing movement of the device along the seabed to facilitate removal of slurry;

a manifold slidably mounted about the lower end of said slurry tube having nozzles depending therefrom about said beveled lower end of and at an acute angle to said slurry tube, and telescoping means connected to said manifold for vertically moving said nozzles relative to said slurry tube and the seabed, to thereby control disaggregation;

means connected to said manifold and nozzles for feeding water under pressure therethrough whereupon the jets of water from said nozzles disaggregate the seabed and form a slurry;

means connected to each of said venturi tubes for feeding water under pressure therethrough wherein a negative pressure is created which causes the slurry to be withdrawn from the seabed into and through said venturi tubes; and guiding means for positioning the device on the conduit as it moves therealong for digging up and burying the conduit.

2. A device as claimed in claim 1, wherein said disaggregating nozzles are about the entire lower end of each of said slurry tubes.

3. A device as claimed in claim 1, including at least one air-tight chamber for adjustment of the buoyancy of the device.

4. A device as claimed in claim 3, wherein each air-tight chamber is removable from the device, and is fixed to the device by quick-connection means.

5. A device as claimed in claim 4, including means for supplying and removing compressed air to each air-tight chamber.

6. A device as claimed in claim 5, including pumping means for supplying air to each air-tight chamber.

7. A device as claimed in claim 1, including propellers for moving the device in the sea when not on the seabed.

8. A device as claimed in claim 1, including at least one hydraulic system for operating the operative members of the device, the hydraulic system being driven by electric motor means disposed in an oil bath.

9. A device as claimed in claim 1, including a flexible floatable cable for connecting the device to a surface vessel and for containing electrical power cables, control and drive connections, and air line means for feeding compressed air to the device.

* * * * *